US007252603B2

(12) United States Patent
Bove et al.

(10) Patent No.: US 7,252,603 B2
(45) Date of Patent: Aug. 7, 2007

(54) COLLAPSIBLE BATTING PRACTICE DEVICE AND FRAME

(75) Inventors: Mauro Bove, San Diego, CA (US); Kenneth Cook, San Diego, CA (US)

(73) Assignee: Solo Sports Group, Inc., SanDiego, CA (US)

( * ) Notice: Subject to any disclaimer, the term of this patent is extended or adjusted under 35 U.S.C. 154(b) by 0 days.

(21) Appl. No.: 11/314,786

(22) Filed: Dec. 21, 2005

(65) Prior Publication Data

US 2007/0142132 A1 Jun. 21, 2007

(51) Int. Cl.
*A63B 69/00* (2006.01)

(52) U.S. Cl. ..... 473/426; 473/451; 473/430

(58) Field of Classification Search ..... 473/421, 473/422, 426, 430, 197; 273/410; 256/24, 256/25, 26

See application file for complete search history.

(56) References Cited

U.S. PATENT DOCUMENTS 3,642,282 A * 2/1972 Frischman ..... 473/478
4,735,413 A * 4/1988 Yamanouchi et al. ..... 473/426
5,040,791 A 8/1991 Ratajac
5,072,927 A 12/1991 Zarate
5,419,550 A * 5/1995 Blom ..... 473/426
5,458,326 A 10/1995 Marcyes
5,539,957 A * 7/1996 Schmidt ..... 473/478
5,588,646 A 12/1996 Dickson
5,681,045 A * 10/1997 Liao ..... 473/478
5,776,017 A * 7/1998 Brawn ..... 473/426
5,795,250 A 8/1998 Cripe
6,086,488 A 7/2000 Sanders
6,168,640 B1 1/2001 McKenna
6,296,581 B1 10/2001 Sever
6,371,873 B1 * 4/2002 Wang ..... 473/478
2006/0223657 A1 * 10/2006 Flanigan ..... 473/423

* cited by examiner

*Primary Examiner*—Mitra Aryanpour
(74) *Attorney, Agent, or Firm*—Frank G. Morkunas

(57) ABSTRACT

A hingedly collapsible batting practice device with a top v-shaped component hingedly connected to two side members and supportable in an approximate horizontal orientation. A rear member attaches to the top of each side member. A bottom v-shaped component hingedly connected to the two side members with a support member for supporting the two side members in an approximate vertical orientation. Each v-shaped component is also hinged at the front to permit each side of the component to pivot toward each other to facilitate collapsing the device. An elastic cord attached to the rear member extends frontward and downward from the top v-shaped component and supports a ball at its terminal end. A non-elastic cord is attached to the ball and each loose end of the non-elastic cord is attached to the bottom v-shaped component.

16 Claims, 5 Drawing Sheets

COLLAPSIBLE BATTING PRACTICE DEVICE AND FRAME

CROSS REFERENCES TO RELATED APPLICATIONS

None.

STATEMENT REGARDING FEDERALLY-SPONSORED RESEARCH OR DEVELOPMENT

None.

BACKGROUND

This currently described device relates to an improvement in batting-practice devices, and more particularly to collapsible and truly portable batting-practice device suitable for batting practice and which is easily collapsible and easily returned to an operational state.

Baseball is an extremely popular sport from the backyard player to the sandlot to schools to professional sports. Many elements are associated with this popular game. Among one of the most important is batting as without good batting skills no runs can be scored. Coaching and practice are key elements to batting in play. A common method of improving a player's swing is to bat against live pitchers or against a pitching machine. This of course requires more than one ball player, in the case of live pitching, or many players merely standing around waiting for their turn to bat in the case of pitching machines. Time and manpower are wasted and pitching machines are costly in purchase and in maintenance. Additionally, most players also like to take practice swings against a baseball during a game while waiting for their turn to bat.

Several batting type devices have been designed for the purpose of permitting a single player to practice swinging at a ball with a bat typically where a single rope or cord was merely tethered to a ball. After striking the ball using this device, the ball would continue to circle around and around until it loses its speed or the cord becomes wrapped around its support structure. In such instances, the player has to reset the ball by unwinding it or waiting for the ball to stop circling. Time is wasted in the process.

A patent to Ratajac (U.S. Pat. No. 5,040,791) teaches a collapsible portable batting cage having an upper frame assembly, a lower frame assembly, a rear frame assembly on top and bottom, and one side frame assembly on each side of the upper and lower frame assemblies. A length of shock cord (elastic bungee type cord) is threaded through a vertical bore hole in a ball. The shock cord attaches to the top front, back to the top rear, and is insertably adjustable into one of a plurality of holes, of pre-determined spacing, on one side of the top rear assembly. The other end of the shock cord attaches to the bottom front and back to the rear frame on the bottom.

The ball is suspended approximately mid-height a the front by a non-elastic line (referred to as a safety line) attached to the ball with its two ends attached at approximately mid-height at the rear on the side frames. The height of the static position of the ball is adjustable by moving the shock cord at the rear frame assembly to different locations. This device is portable due to the nature of its light weight components and it is also collapsible which allows it to be stored or carried in a compact manner. Collapsing this device, however, requires that all fasteners must be removed from the frame components and that the frame components be removed from each other and, when its use is required, that they all be re-assembled. An extremely time-consuming process. In addition, the safety line has a tendency to interfere with a swing which is angled slightly up or down from a perfect horizontal swing.

A patent to McKenna (U.S. Pat. No. 6,186,540) describes a portable apparatus for the practice of a person's batting swings that includes a frame, a net, and a ball attached to non-elastic cords. Each lower terminal end of the frame has a ball-engaging eye bolt. A pair of net-engaging uprights of the frame have a pair of tubes that are formed as one-piece therewith for ease of manufacture by eliminating a need for welding. Button fasteners replaceably maintain the members of the frame together for ease of fabrication and collapsing by eliminating a need for nuts and bolts. A second upper member of the frame has a plurality of ball-engaging blind bores for adjusting the height of the ball.

A lowermost terminal edge of the net drapes so as to prevent any balls from rolling thereunder while providing a dampening effect for the ball when hit against the net. There is no lower cross member which eliminates any rebound of a ball that hits low on the net. One section of the non-elastic cords extend from the ball first upward to the top front then to the side attaching any one of the pre-determined blind bores. Two sections of the non-elastic cords emanate from the bottom of the ball and attach to either bottom rear side of the frame. This device eliminates the problems associated with the safety lines of Ratajac; but, the non-elasticity of the cords limits its effect of travel and renders it slower to rebound and reset.

As with the Ratajac device, this device, though it may be "collapsible" it too must be taken apart for travel and re-assembled when need. Also a time-consuming process. Typically, after each device is first assembled, users generally leave them assembled and either leave them where there are or find a means to transport them, in their assembled state, to the desired location. Either prospect renders each such device less desirable. Moreover, if left assembled, each takes up quite a bit of storage space.

The currently described device solves all the problems associated with the above devices and other prior art devices. Because the frame components are hingedly connected, the entire device is truly collapsible. From its assembled state, the device easily and quickly "folds" into a "dis-assembled" state for storage or transportation and easily and quickly "unfolds" into an assembled stated when it is needed. Height adjustment for the ball is not based on a pre-determined set of height increments but can be adjusted to accommodate even the slightest of increments to the millimeter.

Safety/return lines are structured as not to interfere with a batter's swing and a removably attachable rear elastic cord removably attachable to the ball facilitates resetting of the ball after it has been struck and is a greater practice aid for an experience player. Its removability permits a less experienced player, who may have a tendency to under swing the ball and hit the cord below the ball, to also use the same device by merely removing this cord from the bottom of the ball. Detailed adjustments to all the cord components permits a skilled user to make minute adjustments to tautness to thereby establish a sense of dynamic reality in the batting/swinging practice.

Accordingly, several objects and advantages of the currently described device are to:

a. provide an effective batting-practice device suitable for beginners, intermediate player, and for more experienced players all in one such device.

b. facilitate storage of by creating a collapsible batting-practice which easily unfolds from a collapsed state into an operational state and folds easily into a collapsed state.

c. facilitate transportation of a batting-practice device by establishing collapsibility without necessity of disassembly of frame parts from one another.

d. establish an ability to easily adjust ball height by as low as one millimeter or less, up or down, as suited to a particular user's needs, desires, or skill.

The foregoing has outlined some of the more pertinent objects of the currently described device. These objects should be construed to be merely illustrative of some of the more prominent features and applications of the currently described device. Many other beneficial results can be attained by applying the disclosed currently described device in a different manner or by modifying the currently described device within the scope of the disclosure. Accordingly, other objects and a fuller understanding of the currently described device may be had by referring to the summary of the currently described device and the detailed description of the preferred embodiment in addition to the scope of the currently described device defined by the claims taken in conjunction with the accompanying drawings.

SUMMARY

The above-noted problems, among others, are overcome by the currently described device. Briefly stated, the currently described device contemplates A batting practice device having a bottom component with a first bottom member and a second bottom member which are hingedly attached at the front to each other, a top component with a first top member and a second top member also hingedly attached at the front to each other, a first side member hingedly connected to the back of the first bottom member and hingedly connected to the back of the first top member, a second side member hingedly connected to the back of the second bottom member and hingedly connected to the back of the second top member, a rear member connected to the back of the first top member at one end and to the back of the second top member at its other end, an elastic cord attached to the rear member and one end and extending forward to the front of the top component and downward, a ball removably attached to the downward extending elastic cord, and a non-elastic cord removably and slidingly attached to the ball, wherein one end of this non-elastic cord is removably connected to the first bottom member and the other end of this non-elastic cord is removably connected to the second bottom member.

The foregoing has outlined the more pertinent and important features of the currently described device in order that the detailed description that follows may be better understood so the present contributions to the art may be more fully appreciated. Additional features of the currently described device will be described hereinafter which form the subject of the claims. It should be appreciated by those skilled in the art that the conception and the disclosed specific embodiment may be readily utilized as a basis for modifying or designing other structures and methods for carrying out the same purposes of the currently described device. It also should be realized by those skilled in the art that such equivalent constructions and methods do not depart from the spirit and scope of the currently described device as set forth in the appended claims.

BRIEF DESCRIPTION OF THE DRAWINGS

For a fuller understanding of the nature and objects of the currently described device, reference should be had to the following detailed description taken in conjunction with the accompanying drawings in which.

DETAILED DESCRIPTION

Figure 1:
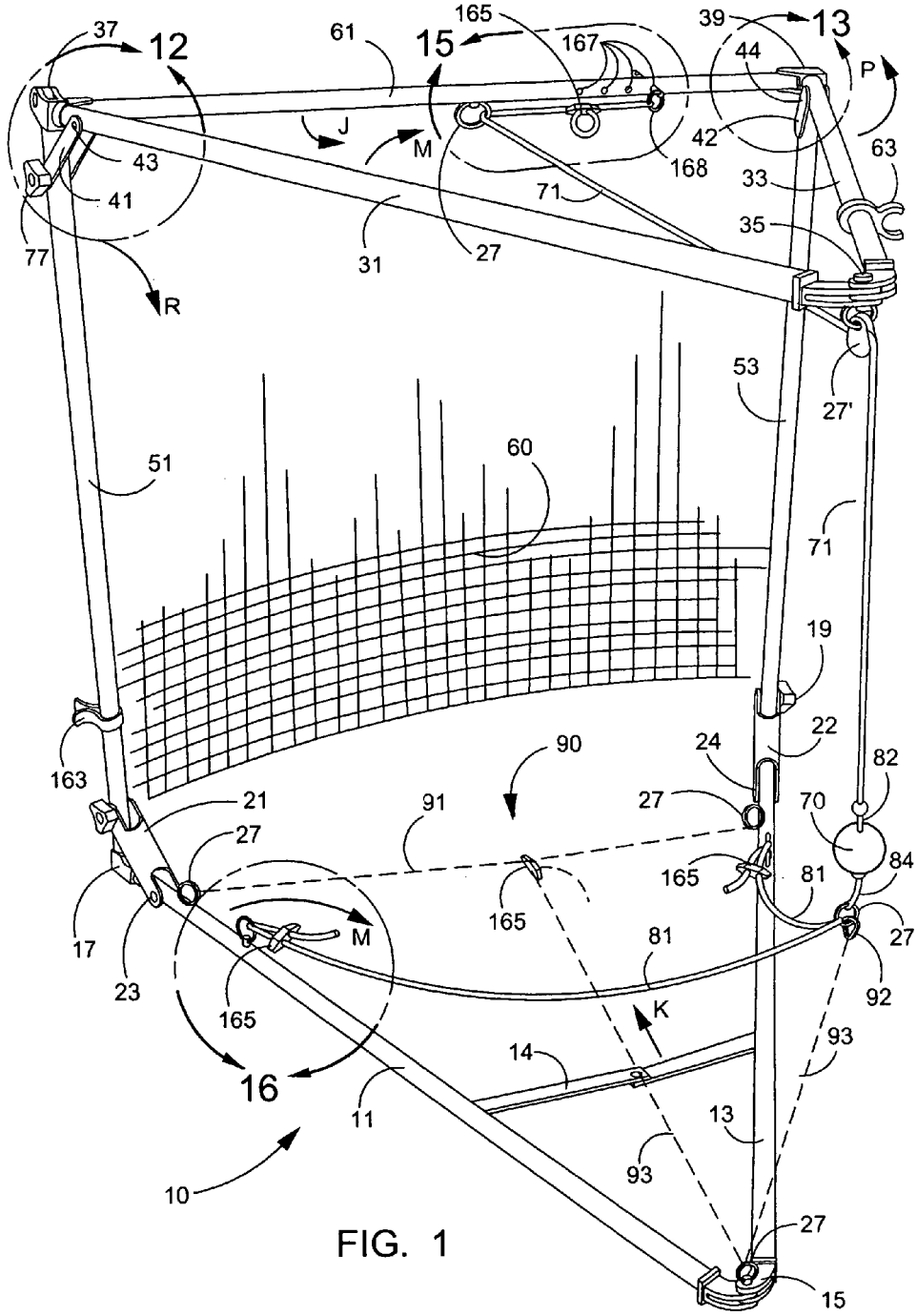
FIG. 1 is perspective view of a collapsible batting-practice device.
Figure 4:
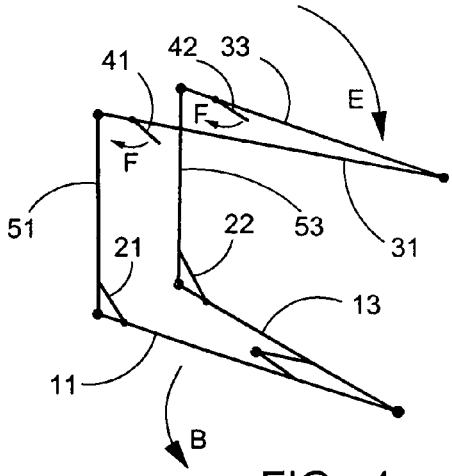

Referring now to the drawings in detail and in particular to FIG. 1, reference character 10 generally designates a collapsible batting-practice device constructed in accordance with a preferred embodiment of the currently described device. It has a bottom v-shaped member comprised of first bottom member 11 pivotably or swivelably connected to a second bottom member 13 by and at the pivot hinge 15. The pivot hinge 15 allows the first bottom member 11 and the second bottom member 13 to move in toward each other, in the direction of arrow M (see also FIG. 8), until they approximately touch and to move away from each other (arrow B or FIG. 4) to thereby form a v-shape.

A bottom support member 14 comprised of two sections which lock in place when the v-shape is formed and folds upon itself, in the direction of arrow K (see also FIG. 7) when the first bottom section 11 and the second bottom section 13 are moved inward towards each other.

Figure 11:
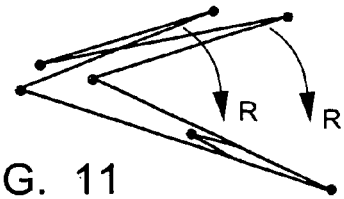

A first side member 51 is pivotably or swivelably connected to the back of the first bottom member 11 by and at the pivot hinge 17. A second side member 53 is pivotably or swivelably connected to the back of the second bottom member 13 by and at the pivot hinge 19. The pivot hinges 17 and 19 allow the first side member 51 to fold onto the first bottom member 11, in the direction of arrow R (see also FIG. 11), and the second side member 53 to fold onto the second bottom member 13 respectively, when the batting-practice device is to be collapsed for transportation or storage.

A top v-shaped member comprised of first top member 31 pivotably or swivelably connected to a second top member 33 by and at the pivot hinge 35. The pivot hinge 35 allows the first top member 31 and the second top member 33 to move in toward each other, also in the direction of arrow M and as to be explained below in tandem with the bottom v-shaped member (see also FIG. 8), until they approximately touch and to move away from each other (arrow B of FIG. 4) to thereby reform the top v-shape. Below the pivot hinge 35 may be a ring-like member 27 or a pulley device 27'.

A bottom support member 14 comprised of two sections locks in place when the v-shape is formed and folds upon itself, in the direction of arrow K (see also FIG. 7) when the first bottom section 11 and the second bottom section 13 are moved inward towards each other.

The first side member 51 is pivotably or swivelably connected to the back of the first top member 31 by and at the pivot hinge 37. The second side member 53 is pivotably or swivelably connected to the back of the second top member 33 by and at the pivot hinge 39. The pivot hinges 37 and 39 allow the first top member 31 to fold over and backward, in the direction of arrow P (see also FIGS. 9 and 10) onto the first side member 31 and the second top member 33 to fold over and backward onto the second side member 53 respectively, when the batting-practice device is to be collapsed for transportation or storage.

These six components (first bottom member 11, second bottom member 13, first side member 51, second side member 53, first top member 31, and second top member 33) are so pivotably connected to one another such that the components easily fold and pivot as described above to form a collapsed unit which is no longer than the longest length of the longest such component and is no wider than the widest width of two components side by side and is no taller than the widest width of three components stacked or folded upon one another.

The unfolding process is schematically illustrated in FIGS. 2 through 6 to thereby place the batting-practice device 10 into a usable operational state. The collapsing or folding process is schematically illustrated in FIGS. 7 through 11 to thereby place or return the batting-practice device 10 into the collapsed state. Not one of the six components described is physically detached from its respective pivotable hinge.

Figure 3:
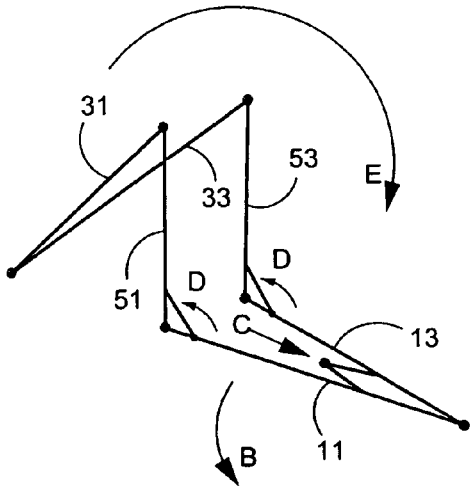
Figure 2:
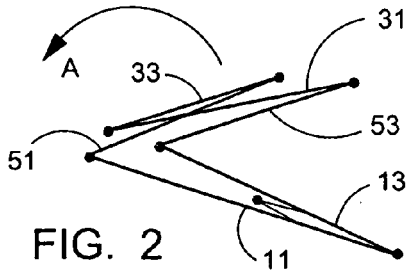

In FIG. 2, to unfold the batting practice device 10 into an operational state, the side members 51, 53 are moved in tandem with top member 31, 33 in the direction of arrow A. In FIG. 3, with the side member 51, 53 in an upright position, the bottom members are moved outward (using first bottom member 11 as an example, in the direction of arrow B. Once the bottom v-shape is formed, the bottom support member 14 in moved in the direction of arrow C to lock-in the v-shape.

The bottom support brackets 21, 22 are moved in the direction of arrow D and locked into the side members 51, 53. The top v-shaped member 31, 33 is then moved up and over the side members 51, 53 in the direction of arrow E. When the top v-shaped member 31, 33 is in the relatively horizontal position depicted in FIG. 4, the top support brackets 41, 42 are moved in the direction of arrow F and locked into place on the respective side members 51, 53.

Figure 6:
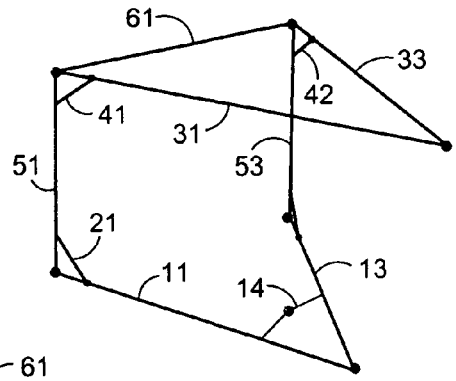
FIGS. 2 through 6 are schematic views of how the batting-practice device is unfolded into an operational state.
Figure 5:
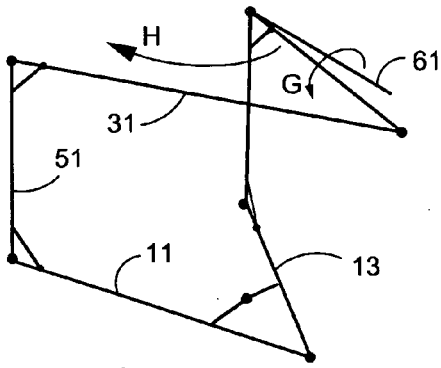

In FIG. 5 the rear member 61, after being pulled from the ring seat 63 (FIG. 1), is rotated in the direction of arrow G and then back in the direction of arrow H to be locked in place onto first side member 51. Once so unfolded, the batting practice device 10 is in the operational state as depicted in FIGS. 1 and 6.

Figure 7:
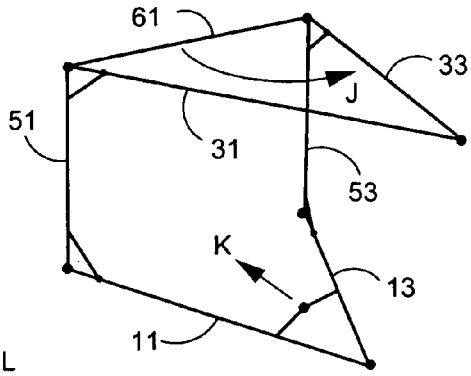
FIGS. 7 through 11 are schematic views of how the batting-practice device is returned to a collapsed state from an operational state.
Figure 8:
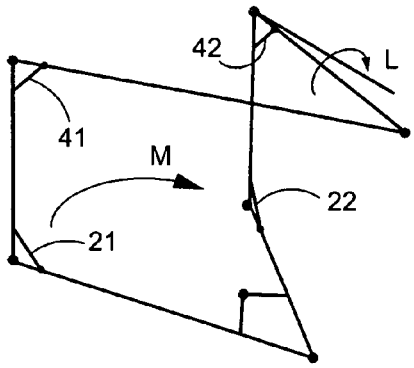

To return to the collapsed stated, the process is reversed and reference is made to FIGS. 7 through 11. Rear member 61 is unlocked and moved in the direction of arrow J and the bottom support member 14 is moved in the direction of arrow K. As seen in FIG. 8, the rear member 61 is rotated in the direction of arrow L and returned to the seat ring 63. The v-shape is folded inward (as illustrated in FIG. 8, this is accomplished by moving the first bottom member 11, the first top member 31, and the first side member 51 in the direction of arrow M toward its opposite members 13, 33, 53.

Figure 9:
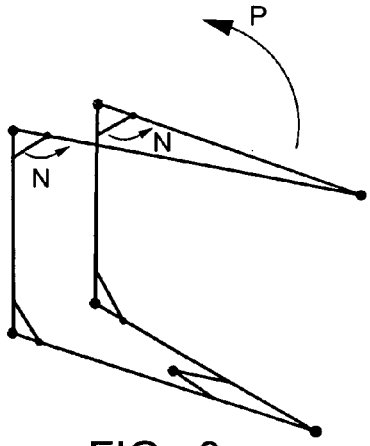
Figure 10:
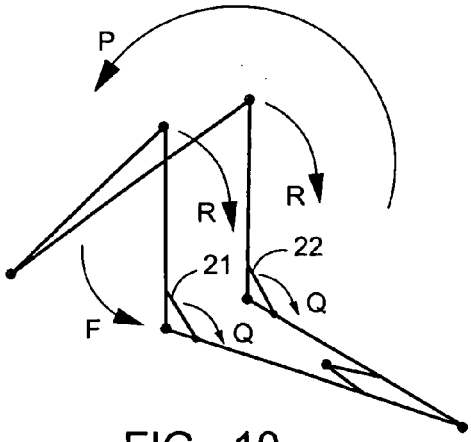

In FIG. 9, the top support members 41, 42 are unlocked from their respective side members and the first top member 31 and second top member 33 are moved up and over the respective side members in the direction of arrow P and continuing as shown in FIG. 10 back toward the side members. This is followed by unlocking bottom support brackets 21, 22 and moving them in the direction of arrow Q. This then permits the downward movement in the direction of arrow R of the side members and top members until them come to rest on the bottom members.

Various support brackets located on one or more of the above-described six components provides the structural support necessary for the batting-practice device 10 to retain the upright v-shape as illustrated in FIG. 1. A first bottom support bracket 21 supports the first side member 51 in an upright position. A second bottom support bracket 22 supports the second side member 53 in an upright position.

Figure 12:
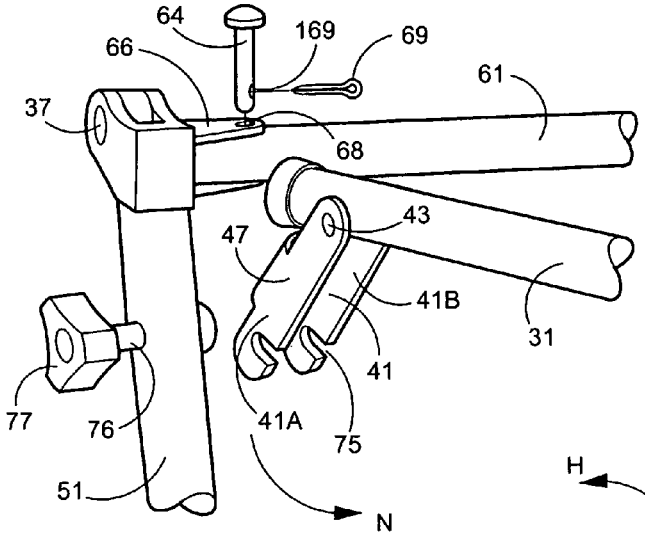
FIG. 12 is a detailed partially exploded view of the support swivel brackets.

Similarly, at the top v-shaped member 31, 33, suitable brackets 41, 42, respectively, support the top v-shaped member in an approximate horizontal position above the bottom v-shaped member 11, 13. Each bracket 21, 22, 41, 42, pivots on respective pivot points 23, 24, 43, 44. This is best illustrated in FIG. 12. Here though the attachment and removal of the bracket 41 is shown as it relates only to first side member 51 and first top member 31, each bracket 21, 22, 41, 42, are configured basically in the same manner and this illustration showing only the first side member 51 and the first top member 31 is for administrative clarity and convenience.

The bracket 41 is pivotably connected to a frame member, here it is shown to be first top member 31. The bracket 41 has two bracket sides 41A, 41B, each with a slot 75 therein. The two bracket sides 41A, 41B, are connected to one another with a connecting plate 47 which as shown is contoured to unobtrusively fit onto the first top member 31. On the adjacent frame member, here shown to be first side member 31, is a protuberance or rod 76 transversing the first side member 31. At one end of the rod 76 is a locking knob 77. The locking knob 77 may be on the inside of the respective frame member or on the outside of the frame as is illustrated here.

The locking knob 77 has an internal threaded core and the end of the rod 76 has corresponding external threading to receiving the locking knob 77. After the slot 75 of the bracket 41 is placed on the rod 76, the locking knob 77 is rotated in a direction which moves it inward toward the bracket 41. Such rotation is continued until the locking knob 77 is tightly pressed against the bracket 41 and the bracket tightly pressed against the first side member 51.

Such placement of all respective brackets 21, 22, 41, 42, establish and maintain the operational state of the batting-practice device 10. Such "locking" by the locking knob 77 helps to maintain that structural integrity of the device 10. To collapse the batting practice device 10, the locking knob 77 is untightened, the bracket 41 lifted off the rod 76 and moved in the direction of arrow N (see also FIG. 9). After the same process is executed at the opposite end (second side member 53, second top member 33, and second top support bracket 42), the v-shaped top member 31, 33 may be moved up in the direction of arrow P and up and over and back to the respective side members 51, 53 (see also FIG. 10).

For greater structural support, a rear member 61 is illustrated in FIG. 1. It is hingedly attached on one side member and removably connected to the other side member. It should be understood that the sides to which hingedly attached and removably connected may be reversed. As illustrated in FIG. 1, in general, and FIGS. 12, and 13, in detail, the rear member 61 is hingedly attached to the back of the second top member 33 by and at the pivot and rotatable hinge 62. A ring-like member 27 or loop or pulley 27' is at the approximate mid-point of the rear member 61 for receiving the elastic cord 71.

Figure 13:
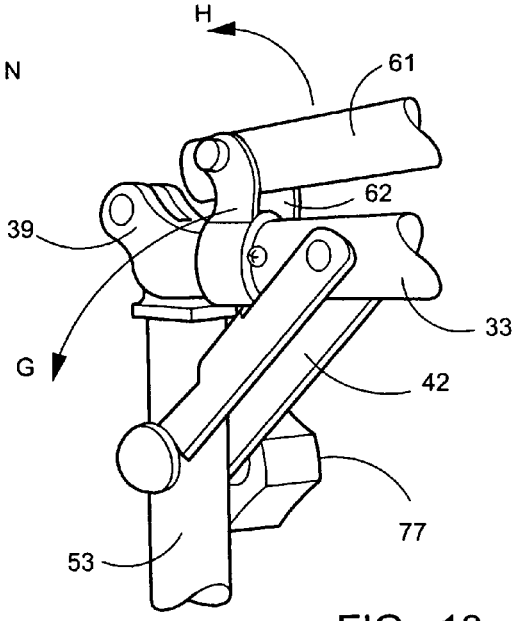
FIG. 13 is a detailed view of the pivotable and rotatable structure of the rear member.

FIG. 13 illustrates the dual pivot or swivel concept of the rear member 61. Since the rear member 61 is pivotally attached to rotatable hinge 62 at the rear of the second top member 33, this allows the rear member 61 to be pivoted in the direction of arrow G. The rotatable hinge 62 is attached to the rear of the second top member 33 also in a pivotable manner to thereby permit pivoting in the direction of arrow H (see also FIG. 8). Executing those movements brings the rear member 61 up from its collapsed state on the second top member 3 and over toward the first side member 51 for connection thereto as described above.

This pivot and rotatable hinge 62 allows the rear member 61 to move, first in the direction of arrow J (see also FIG. 7)

inward (or outward) toward the second top member 33 and then rotate over it approximately 180° (in the direction of arrow L in FIG. 8). Once so pivoted and rotated it may be placed into seat ring 63 and, when the batting practice device 10 is collapsed, it moves and folds along with the top v-shaped member 31, 33.

In its operational state (i.e., uncollapsed and useable), the rear member 61 is locked into place adjacent to the first side member 51 with a connecting pin 64 insertable through an aperture 68 on a retainer 66 on the first side member 51. The connecting pin 64 has a small hole 169 for receiving a fastening member 69 such as a cotter pin or similar suitable fastening member.

Figure 14:
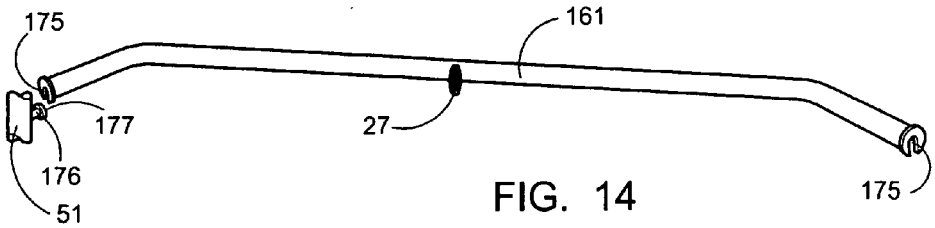
FIG. 14 is a detailed view of a second embodiment of the batting practice device with a removable rear member.

FIG. 14 illustrates another embodiment of the batting practice device 10 however with a fully removable rear member 161. Each side member 51, 31 has an extending rod-like member 176 with a stop 177 at its distal end (the first side member 51 is illustrated in this figure). The removable rear member 161 is angled inward at each end and has a slot 175 at each end which is to be placed onto and over the rod-like member 176. A ring-like member 27 or loop or pulley 27' is at the approximate mid-point of the removable rear member 161 for receiving the elastic cord 71.

The main cord components of the batting practice device 10, as illustrated in FIG. 1, are the elastic cord 71 and the non-elastic cord 81. A ball 70 is nested in between in the manner shown and to be described. The ball 70 may have a top ball member 82 attached to it which may be adapted to be removable from the elastic cord 71. The ball 70 has a bottom ball member 84 attached thereto which has a ring-like member 27 attached thereto adapted to receive the non-elastic cord 81.

The elastic cord or line 71 may be of any suitable cord or line having elastic qualities, including, but not limited, to bungee cords. The non-elastic cord 81 may be of any cord or line or rope having non-elastic qualities.

After the frame of the batting practice device 10 is placed into its operational state, the ball and cord components are placed thereon. The loose end of the elastic cord 71 (end without the ball component) is run through the pulley 27' and back to the ring 27 on the rear member 61 and then over to and secured into or onto any one aperture 167 on the rear member 61. Placement into an aperture 167 closer to the second top member 33 will reduce slack of the cord component or adjust the height of the ball 70 upward. Placement into an aperture closer to the first top member 31 will increase slack of the cord component or adjust the height of the ball downward.

As so threaded, the ball 70 will hang down from the pulley 27' with the ring 27 at the end of the bottom ball member 84 also hanging loosely. The non-elastic cord 81 is run through the ring 27 on the bottom ball member 84 and one loose end thereof attached to the ring 27 near to the rear of the first bottom member 11 and the other loose end attached to the ring 27 near to the rear of the second bottom member 13. These ends may be secured at their respective rings by tying or by use of an adjustable member to be described later.

As configured, this is referred to a three-cord system. The height of the ball 70 may be adjusted up or down by placement of the far end of the elastic cord 71 into a suitable aperture 167 on the rear member 61.

Figure 15:
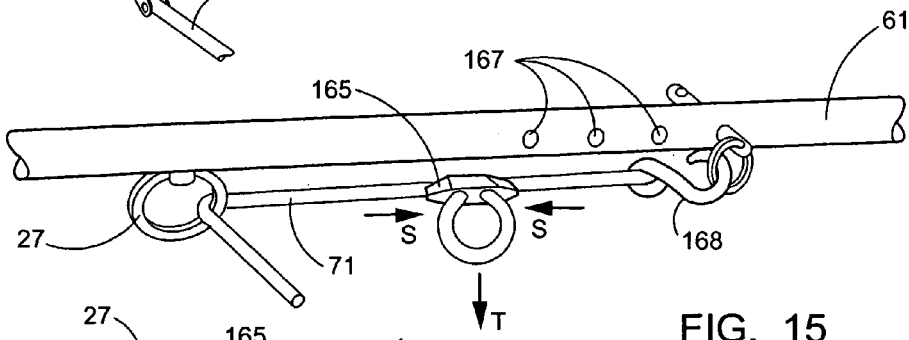
FIG. 15 is a detailed view of the adjustment component of the flexible cord.
Figure 16:
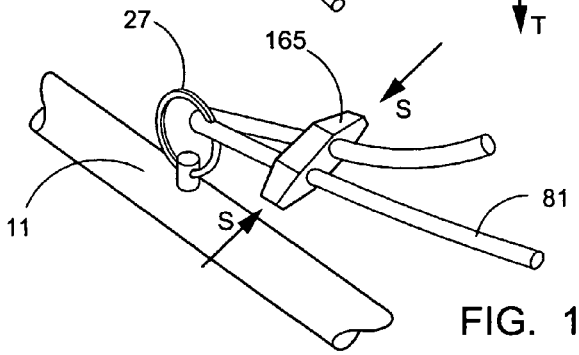
FIG. 16 is a detailed view of the adjustment component of the non-flexible cord.

Reference is now made to FIGS. 1, 15, and 16. FIG. 15 shows the rear member 61 (non-removable) and the elastic cord 71 position, retention, and adjustability. As previously described, this rear member 61 also has a ring-like member 27 at its approximate mid-point through which the elastic cord 71 is placed from the front, through, and over to the side attaching to a suitable member such as a hook 168 as illustrated or a ring-like member having an elongated rod attached thereto. The hook 168 may be insertable into any one of the apertures 167 on the rear member 61. The closer to the center of the rear member 61 the hook 168 is inserted, the more 'play' or 'slack' in the elastic cord 71.

The elastic cord 71 is threaded through a spring-clip 165. The spring-clip 165 is at a point between the ring-like member 27 and the hook 168 and provides for detailed adjustments to the elastic cord 71. The elastic cord 71 is run through one hole on the left side (as illustrated) of the spring-clip 165 and down through another hole on the right side of the spring-clip 165 and toward the side to the hook 168. A loop is formed as illustrated in FIG. 15.

The spring-clip 165 is of the type which, when pinched in the directions of arrow S loosens its grip on the elastic cord 71 thereby permitting the user to pull the loop out in the direction of arrow T to make the elastic cord 71 more taut by extremely detailed and minimal degrees or to push the loop in the opposite direction to slacken the elastic cord 71. This allows a user to adjust the feel of the ball-cord relationship to best suit the user's needs or desires.

A similar spring-clip 165 is also used on the respective bottom members 11, 13 as illustrated in FIGS. 1 and 16. In this use, the loop is what is passed through and retained by and at the ring 27 as the non-elastic cord 81 is passed through the ring 27. The non-elastic cord 81 may be adjusted here at both sides by pinching the spring-clip 165 as previously described and pulling the non-elastic cord 81 from either side to tighten or loosen the slack on the non-elastic cord 81 as desired.

Reference is now made to FIG. 1 to described the use of a fourth cord with the batting practice device 10. The fourth cord is represented in dashed line bearing reference character 90. It is comprised of a rear cord or line 91, which may be elastic or non-elastic in nature, attached to the bottom rear of the batting practice device 10 and a bottom cord or line 93, of elastic or non-elastic qualities, attached at one end to the rear cord 91 with a spring-clip 165 and removably attached at the other end to the ball components 70, 84 with clip-like member 92.

The fourth cord concept permits the ball 70 to re-set more quickly. It is adjustable to add greater dimension to the batting practice and provides the user with dynamic reality. This is particularly so when at least one of the lines 91 or 93 are elastic. Better dynamic reality is achieved when both lines, 91 and 93, are elastic.

Less experienced hitters may find the fourth cord cumbersome and difficult in that their bat may be fouled into the cord either above or below the ball. Their swinging technique being not well refined. More experienced hitters, with a more controlled swing, will not be confronted with that problem and will find the ability to re-set of greater advantage. They will get more practice swings per minute than users not using the fourth cord. The fourth cord is removable and adjustable by way of the spring-clip 165.

Attached to the rear of the batting practice device 10 is a suitable backing or backstop or net 60 to stop the ball 70 and facilitate it to re-set for the next swing. The net 60 is removably attachable to the rear by any suitable attachment member such as, but not limited to, hook-and-loop tabs, ties, string 163, and the like. Hook-and-loop is preferred. The net 60 may be a solid sheet or actual netting.

Figure 17:
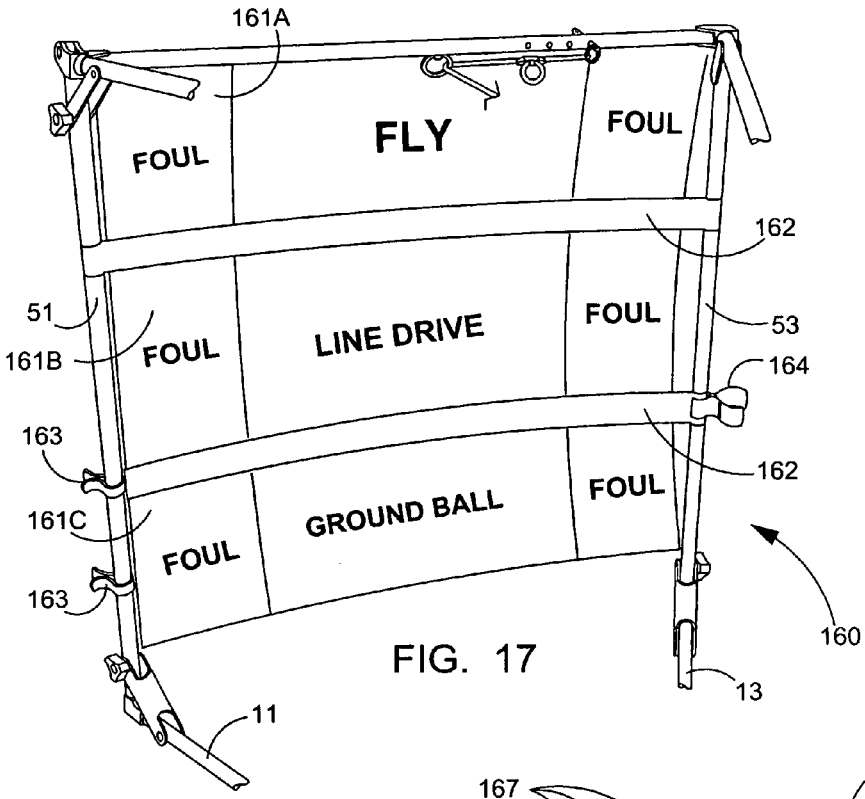
FIG. 17 is another embodiment of the backstop for the batting practice device.

Another embodiment of the net 160 has indicia which conveys qualitative information to a user, such as, but not limited to, the type or quality of the user's swing and/or hit, how hard or weak the ball was hi, whether fair or foul, ground ball, line drive, or fly ball. As illustrated in FIG. 17, hit-indicia is utilized wherein indicia one 161A represents a fly ball, indicia two 161B represents a line drive hit, and indicia three 161C represents an ground ball. A suitable border 162 separates the various hit indicia 161A, 161B, and

161C. The borders 162 may be permanently placed on the net 160 or be removable and consequently adjustable by use of clips 164 or hook-and-loop 163 on the border 162.

The present disclosure includes that contained in the present claims as well as that of the foregoing description. Although this currently described device has been described in its preferred form with a certain degree of particularity, it is understood that the present disclosure of the preferred form has been made only by way of example and numerous changes in the details of construction and combination and arrangement of parts and method steps may be resorted to without departing from the spirit and scope of the currently described device. Accordingly, the scope of the currently described device should be determined not by the embodiments illustrated, but by the appended claims and their legal equivalents.

What is claimed is:

1. A batting practice device comprising:

(a) a bottom component having a first bottom member with a front and a back and a second bottom member with a front and back wherein the front of said first bottom member is hingedly attached to the front of said second bottom member;

(b) a top component having a first top member with a front and a back and a second top member with a front and back wherein the front of said first top member is hingedly attached to the front of said second top member;

(c) a first side member hingedly connected to the back of said first bottom member and hingedly connected to the back of said first top member;

(d) a second side member hingedly connected to the back of said second bottom member and hingedly connected to the back of said second top member;

(e) a rear member connected to the back of the first top member at one end and to the back of the second top member at its other end;

(f) an elastic cord having a first end and a second end, wherein said first end is attached to said rear member and said second end extends forward to the front of said top component and downward from the front of said top component;

(g) a ball removably attached to the second end of said elastic cord; and (h) a non-elastic cord removably and slidingly attached to said ball, wherein a first end of said non-elastic cord is removably connected to said first bottom member and a second end of said non-elastic cord is removably connected to said second bottom member.

2. The device as claimed in claim 1 wherein said rear member is removably connected to the back of either the first top member or the second top member and is pivotably and rotatably connected to the back of its opposite top member.

3. The device as claimed in claim 1 wherein said rear member is removably connected to the back of said first top member and removably connected to the back of said second top member.

4. The device as claimed in claim 1 further comprising a backstop removably attachable to said first side member and to said second side member or removably attachable to said rear member or removably attachable to said first side member and to said second side member and to said rear member.

5. The device as claimed in claim 4 wherein said backstop further comprises indicia thereon conveying qualitative information to a user.

6. The device as claimed in claim 1 further comprising an elastic-line component comprising a first line removably attachable each bottom member adjacent to their respective said back; and comprising a second elastic line removably attachable at one end to said first line and at its other end being removably attachable to said ball.

7. The device as claimed in claim 6 wherein said second line further comprises a line adjustment means for adjusting tension for said second line.

8. The device as claimed in claim 6 wherein said first line is non-elastic.

9. The device as claimed in claim 6 wherein said first line is elastic.

10. The device as claimed in claim 6 wherein said second line is non-elastic.

11. The device as claimed in claim 6 wherein said second line is elastic.

12. The device as claimed in claim 1 further comprising elastic-cord adjustment means for adjusting tension for said elastic cord or for adjusting ball height for said ball or both.

13. The device as claimed in claim 1 further comprising support means for supporting said top component in an approximate horizontal position and for supporting said first side member and said second member in an approximate vertical position.

14. The device as claimed in claim 13 wherein said support means comprises a swivel bracket on said first top member securingly attachable to said first side member, a swivel bracket on said second top member securingly attachable to said second side member, a swivel bracket on said first bottom member securingly attachable to said first side member, and a swivel bracket on said second bottom member securingly attachable to said second side member.

15. The device as claimed in claim 13 wherein said support means comprises a swivel bracket on said first side member securingly attachable to said first top member, a swivel bracket on said second side member securingly attachable to top second side member, a swivel bracket on said first side member securingly attachable to said first bottom member, and a swivel bracket on said second side member securingly attachable to said second bottom member.

16. The device as claimed in claim 1 further comprising a support member attached at one end to said first bottom member and at it other end attached to said second bottom member wherein said support member is swivelable in either direction at its approximate center.

* * * * *